US008246195B2

(12) United States Patent
Yan et al.

(10) Patent No.: US 8,246,195 B2
(45) Date of Patent: Aug. 21, 2012

(54) LED SIDE MARKER LAMP

(75) Inventors: Xing Yan, Foshan (CN); Chuangda Nie, Foshan (CN); Shuguang Jin, Foshan (CN)

(73) Assignee: Foshan Nationstar Optoelectronics Co., Ltd., Foshan, Guangdong (CN)

( * ) Notice: Subject to any disclaimer, the term of this patent is extended or adjusted under 35 U.S.C. 154(b) by 361 days.

(21) Appl. No.: 12/715,109

(22) Filed: Mar. 1, 2010

(65) Prior Publication Data

US 2011/0163688 A1 Jul. 7, 2011

(51) Int. Cl.
*F21V 1/00* (2006.01)

(52) U.S. Cl. ..... 362/217.12; 362/545; 362/217.01

(58) Field of Classification Search ..... 362/221–223, 362/225, 249.01, 249.02, 543–545, 555, 362/217.01, 217.1–217.17
See application file for complete search history.

(56) References Cited

U.S. PATENT DOCUMENTS

| | | | | |
|---|---|---|---|---|
| 5,313,729 | A * | 5/1994 | Sakai et al. | 40/452 |
| 6,056,420 | A * | 5/2000 | Wilson et al. | 362/249.03 |
| 6,789,930 | B2 * | 9/2004 | Pederson | 362/545 |
| 6,880,952 | B2 * | 4/2005 | Kiraly et al. | 362/218 |
| 7,288,796 | B2 * | 10/2007 | Dry | 257/88 |
| 2004/0012959 | A1 * | 1/2004 | Robertson et al. | 362/247 |
| 2008/0273326 | A1 * | 11/2008 | Wilcox et al. | 362/249 |

* cited by examiner

*Primary Examiner* — Julie Shallenberger
(74) *Attorney, Agent, or Firm* — Morris, Manning & Martin, LLP; Tim Tingkang Xia, Esq.

(57) ABSTRACT

A light emitting diode (LED) side marker lamp, comprising a punching panel with a coating, a water-proof light source module, and a through hole. The water-proof light source module is disposed below the punching panel, and the through hole is disposed on the punching panel and operates to allow light to be emitted from the water-proof light source module. A traditional cover is not needed, and the punching panel is used to replace the cover and colors thereof match with those of buildings, which improves decoration effect of the invention; secondly, as the LED side marker lamp fails, only the water-proof light source module needs to be replaced, which is convenient for maintenance and reduces cost; finally, the number of light source modules can be varied, which is flexible in use.

17 Claims, 6 Drawing Sheets

LED SIDE MARKER LAMP

CROSS-REFERENCE TO RELATED APPLICATIONS

This application claims the benefit of Chinese Patent Application No. 201020056321.0 filed on Jan. 6, 2010. The disclosures of the above applications are incorporated herein by reference.

BACKGROUND OF THE INVENTION

1. Field of the Invention

The invention relate to a side marker lamp, and more particularly to an LED side marker lamp.

2. Description of the Related Art

LED side marker lamp is also called guardrail lamp or digitron. It is mainly used to decorate outline of buildings, overpasses, river courses, gardens, and lamp posts. A traditional LED side marker lamp comprises a cover, a LED line board disposed inside the cover, multiple LED lamps installed on the line board, and electric lines connected to the line board and extending from the cover. However, this kind of LED side marker lamp is not effective in decoration during the day time since colors thereof (milk or transparent) do not match with decorated buildings that feature various colors. Moreover, the cover will become yellow due to aging after one or half year.

In addition, the traditional LED side marker lamp is fixed in terms of specifications. For example, the cover usually has a diameters of ϕ30, ϕ50, ϕ80, ϕ100, or ϕ110, a color of milk or transparent, and a length of 500,800,1000,1200, or 1500. The number of built-in LED lamps thereof is normally 99, 108, or 144. All the specifications cannot be changed. If specification needs to be adjusted, the whole LED side marker lamp needs to be made again, which requires higher cost and a long production period. Furthermore, the traditional LED side marker lamp uses a cover and end cover connected via water-proof glue whereby preventing water, if the lamp fails, the water-proof glue and the cover need to be removed, and the entire LED line board needs to be replaced, which brings about inconvenience for maintenance and high cost.

SUMMARY OF THE INVENTION

In view of the above-described problem, it is one objective of the invention to provide a stator for a LED side marker lamp that is capable of addressing the above-mentioned problems.

To achieve the above objectives, in accordance with one embodiment of the invention, provided is a light emitting diode (LED) side marker lamp, comprising a punching panel with a coating, a water-proof light source module, and a through hole. The water-proof light source module is disposed below the punching panel, and the through hole is disposed on the punching panel and operates to allow light to be emitted from the water-proof light source module.

In a class of this embodiment, it further comprises a bottom slot operating to support the punching panel.

In a class of this embodiment, it further comprises a pair of first openings being disposed on both ends of the bottom slot, and an end cover being disposed at each first opening.

In a class of this embodiment, a second opening is disposed at the top of the bottom slot, a buckling slot is disposed at the second opening, a protruding portion bending inwards is disposed at the edge of the punching panel and fit with the buckling slot, and the punching panel is interference-fit in the buckling slot.

In a class of this embodiment, a second opening is disposed at the top of the bottom slot, a buckling slot is disposed at the second opening and fit with the punching panel, and the punching panel is clearance-fit in the buckling slot.

In a class of this embodiment, the punching panel is groove-shaped, and an edge thereof bends outward whereby forming a receiving edge.

In a class of this embodiment, the water-proof light source module comprises a plurality of light source units, each light source unit comprises a groove-shaped shell, a PCB board, at least one LED lamp, and a water-proof insulation layer, said PCB board is disposed in the groove-shaped shell, the LED lamp is disposed on the PCB board, and the water-proof insulation layer operates to cover the PCB board and part of the LED lamp.

In a class of this embodiment, the groove-shaped shell is made of metal or plastics.

In a class of this embodiment, the LED lamp is one of a red-light LED lamp, a green-light LED lamp, a blue-light LED lamp, or a combination thereof.

In a class of this embodiment, the light source unit further comprises a communication electronic component operating to control on or off of the LED lamp.

In a class of this embodiment, it further comprises a communication line operating to connect the water-proof light source module to an external control unit.

In a class of this embodiment, it further comprises a built-in control unit connected to the communication electronic component of said water-proof light source module and operating to turn on the light source unit one by one.

In a class of this embodiment, it further comprises a power bus operating to connect adjacent LED side marker lamp or an external power supply.

In a class of this embodiment, the multiple LED side marker lamps are connected to each other via power lines.

In a class of this embodiment, it further comprises multiple water-proof power supplies disposed on the punching panel or in the bottom slot.

In a class of this embodiment, the number of the water-proof power supplies is the same as that of the LED side marker lamps.

In a class of this embodiment, the number of the water-proof power supplies is one, and multiple LED side marker lamps connected to each other share the same water-proof power supply.

Advantages of the invention comprise: a cover of the traditional LED side marker lamp is not needed, and the punching panel is used to replace the cover and colors thereof match with those of buildings, which improves decoration effect of the invention; firstly, as the LED side marker lamp fails, only the water-proof light source module needs to be replaced, which is convenient for maintenance and reduces cost; secondly, each water-proof light source unit comprises 3 to 6 LED lamps, and the LED side marker lamp per meter contain 5 to 20 water-proof light source units whereby having different specifications, and thus use of the LED side marker lamp is flexible; finally, other electric components, the LED, the double-layered PCB board, the communication line and welding points of the power line are disposed in the water-proof insulation layer, and the light source module can work for long time with high reliability and stability.

BRIEF DESCRIPTION OF THE DRAWINGS

Detailed description will be given below in junction with accompanying drawings, in which.

DETAILED DESCRIPTION OF THE INVENTION

Figure 1A:
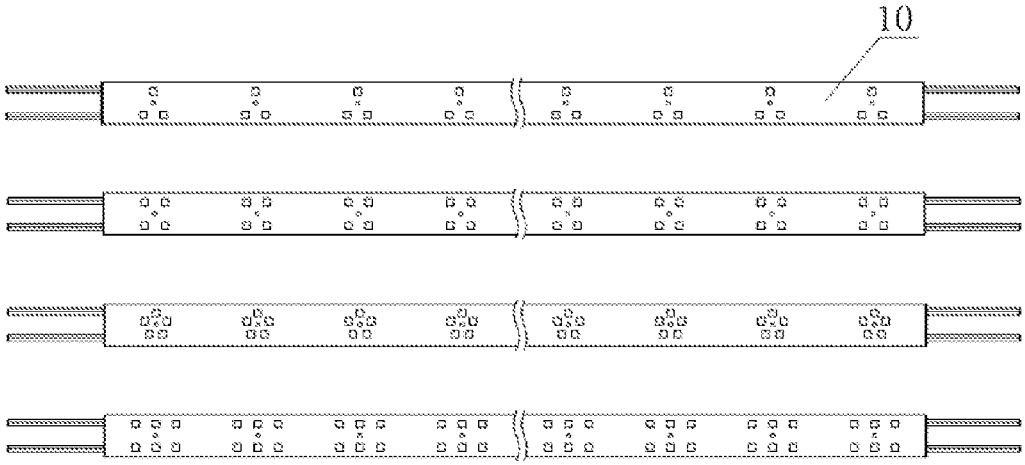
FIG. 1*a* is a front view of a LED side marker lamp of a first embodiment of the present invention.
Figure 1B:
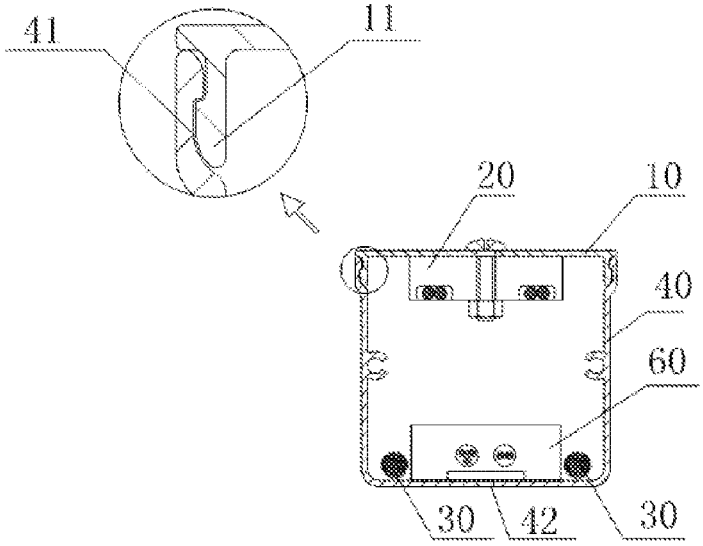
FIG. 1*b* is a cross-sectional structure view of a LED side marker lamp in FIG. 1*a;*
Figure 1C:
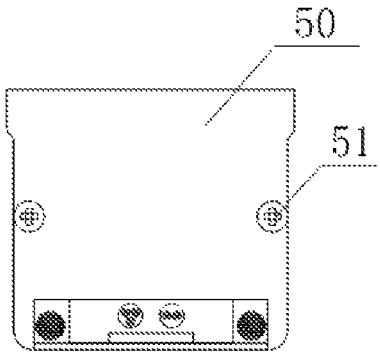
FIG. 1*c* is schematic view of an end cover of a first embodiment of the present invention.

As shown in FIGS. 1-3, a LED side marker lamp of the invention comprises: a punching panel 10 with a coating, a water-proof light source module 20, a through hole (not shown), a power bus 30, a bottom slot 40, and an end cover 50.

The water-proof light source module 20 is disposed below the punching panel 10.

The power bus 30 operates to connect adjacent LED side marker lamp or an external power supply (as shown in FIG. 1*b*).

The bottom slot 40 operates to support the punching panel 10, and a pair of first openings is disposed on both ends of the bottom slot 40. Advantageously, the bottom slot 40 is made of aluminum.

The end cover 50 is disposed at the first opening.

A second opening is disposed at the top of the bottom slot 40, a buckling slot 41 is disposed at the second opening, and a receiving hole 42 is disposed at the bottom of the bottom slot 40, and operates to receive the LED side marker lamp.

The through hole is disposed on the punching panel 10 and operates to allow light to be emitted from the water-proof light source module 20 (not shown). In this embodiment, the punching panel is made of aluminum.

A protruding portion 11 bending inwards is disposed at the edge of the punching panel 10 and fit with the buckling slot 41, and the punching panel 10 is interference-fit in the buckling slot 41. The same colors as decorated buildings are coated on an upper portion of the punching panel 10, and thus no cover is needed, no discoloration occurs, and decoration effect is greatly improved.

The power bus 30 is disposed in the bottom slot 40 and passes through the end cover 50. This arrangement makes the power line invisible and thus makes decoration effective even better. In this embodiment, the power bus 30 comprises a power line and a communication line, and only externally-controlled LED side marker lamp requires the communication line.

Still referring to FIG. 1*b*, the LED side marker lamp further comprises water-proof supply 60 disposed in the bottom slot 40.

In the present invention, the water-proof light source module 20 is fixed at the bottom of the punching panel 10 via a screw and a nut. An installation process of the LED side marker lamp is as follows: firstly, the end covers 50 are installed on both ends of the bottom slot 40 via tapping screws 51, and the power bus 30 is led out from the cover 50; then, the bottom slot 40 is fixed to the decorated building via the receiving hole 42 at the bottom of the bottom slot 40; and finally, the punching panel 10 with the water-proof light source module 20 is interference-fit with the slot 41 of the bottom slot 40.

Figure 2A:
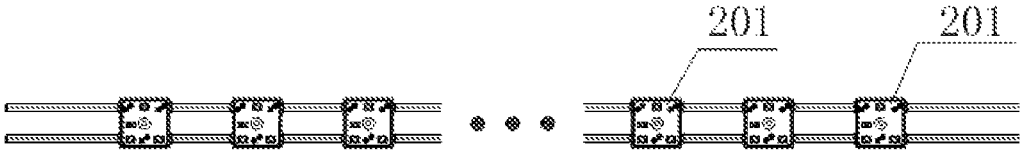
FIGS. 2*a*-2*c* are front views of a water-proof light source module.
Figure 2B:
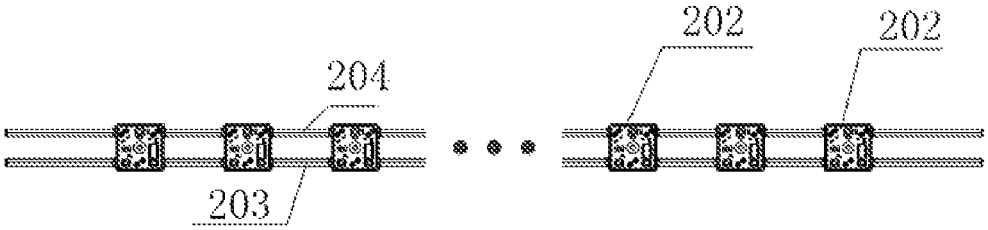
Figure 2C:
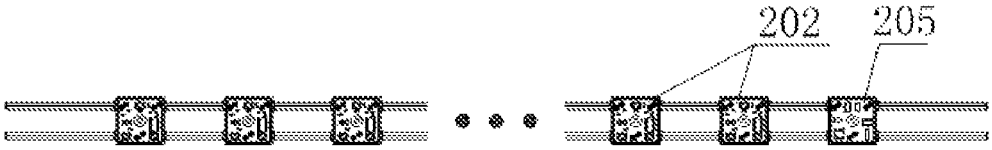

Referring to FIGS. 2*a*-2*c*, the water-proof light source module is divided into three types: a single color/three-color (red, green, and blue) water-proof light source module (as shown in FIG. 2*a*), an externally-controlled point-by-point water-proof light source module (as shown in FIG. 2*b*), and an internally-controlled point-by-point water-proof light source module (as shown in FIG. 2*c*). In details, the single color/three-color water-proof light source module comprises multiple single color/three-color (red, green, and blue) water-proof light source units 201 with no control unit being connected thereto. Therefore, all light source units are simultaneously switched on or off. The single-color water-proof light source module has a single color and can operate normally via two power lines, and the three-color water-proof light source module can normally operate via four power lines and display synchronous change of seven colors.

The externally-controlled point-by-point water-proof light source module comprises a plurality of point-by-point water-proof light source units 202. Each point-by-point water-proof light source units 202 is connected to an external control unit (not shown) whereby implementing controlling of each water-proof light source unit, such as point-by-point illumination. As the externally-controlled point-by-point water-proof light source module is used, the LED side marker lamp needs communication lines 204, other than power lines 203, for connecting the water-proof light source module to the external control unit and for implementing the transmission of a communication signal. In the present invention, the difference between the point-by-point water-proof light source unit 202 and the water-proof light source unit 201 in FIG. 2*a* is that the water-proof light source unit 202 further comprises a communication electronic component operating to control on or off of the LED side marker lamp. The externally-controlled point-by-point water-proof light source module can be different if it is connected to an external controller.

The internally-controlled point-by-point water-proof light source module comprises a plurality of point-by-point water-proof light source units 202 and a built-in control unit 205 operating to control illumination of the lamps one by one. Since the built-in control unit 205 implements variation of seven colors point by point, and variation thereof can be adjusted as being connected to a PC, it is simple for repairing and convenient for replacement, thus thus maintenance cost is reduced.

Figure 2D:
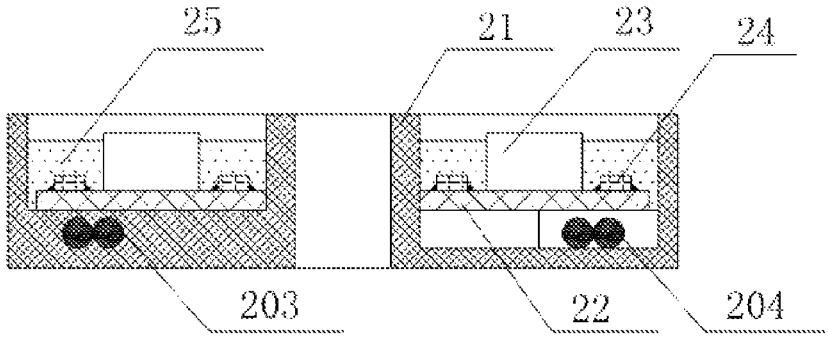
FIG. 2*d* is a cross-sectional view of a LED side marker lamp in FIG. 2*b;*

Referring to FIG. 2*d*, a water-proof light source comprises a plurality of water-proof light source units, each comprising: a groove-shaped shell 21, a printed circuit board (PCB) 22 disposed in the groove-shaped shell 21, at least one LED lamp 23 installed on the PCB 22, a communication electronic component 24 operating to control the LED lamp 23, a water-proof insulation layer 25 covering the PCB 22 and part of the LED lamp 23, and a power line 203 and a communication line 204 led out from the groove-shaped shell 21.

The groove-shaped shell 21 can be made of metal and plastics. Namely, material of the groove-shaped shell is determined by heat value of the LED lamp 23 and other electronic components. If the heat value is high, a metal shell is used; otherwise, a plastic shell is used.

In this embodiment, the PCB 22 is a double-layered PCB board, the LED lamp 23 is one of a red-light LED lamp, a green-light LED lamp, a blue-light LED lamp, or a combination thereof. The number of LED lamps 23 is the same as that of the through-holes on the punching panel 10, which allows all light generated by the LED lamps 23 to be emitted from the punching panel 10. In the present invention, each water-proof light source unit comprises 3 to 6 LED lamps, and the LED side marker lamp per meter contain 5 to 20 water-proof light source units whereby having different specifications. Thus, use of the LED side marker lamp is flexible.

The water-proof insulation layer 25 is made from epoxy resin or silicone grease, completely covers the double-layered PCB board, the LED lamp 23, welding points of pins of the communication electronic component 24, and the power lines, leaves the light emitting surface of the LED lamp 23 exposed, features good water proof performance, and can be used in outdoor environment for long time with high stability and reliability. In addition, it allows the light to be smoothly emitted from the LED lamp 23 via the through-hole of the punching panel 10.

In another embodiment of the present invention, if a non-externally controlled LED side marker lamp is used, the communication line 204 can be omitted.

For the invention, a cover of the traditional LED side marker lamp is not needed, and the punching panel is used to replace the cover and colors thereof match with those of buildings, which improves decoration effect of the invention; secondly, as the LED side marker lamp fails, only the water-proof light source module needs to be replaced, which is convenient for maintenance and reduces cost; thirdly, each water-proof light source unit comprises 3 to 6 LED lamps, and the LED side marker lamp per meter contain 5 to 20 water-proof light source units whereby having different specifications. Thus, use of the LED side marker lamp is flexible; finally, other electric components, the LED, the double-layered PCB board, the communication line and welding points of the power line are disposed in the water-proof insulation layer, and the light source module can work for long time with high reliability and stability.

Figure 3A:
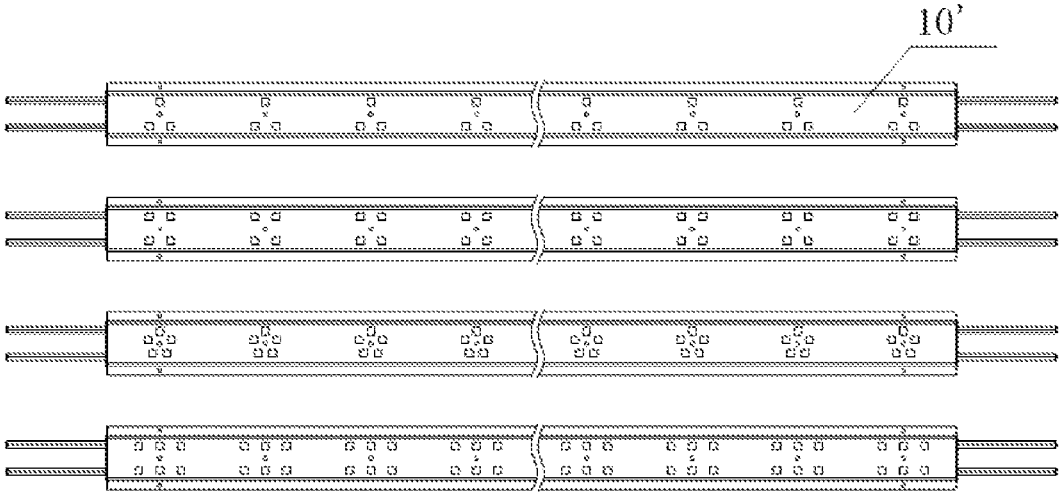
FIG. 3*a* is a front view of a LED side marker lamp of a second embodiment of the present invention.
Figure 3B:
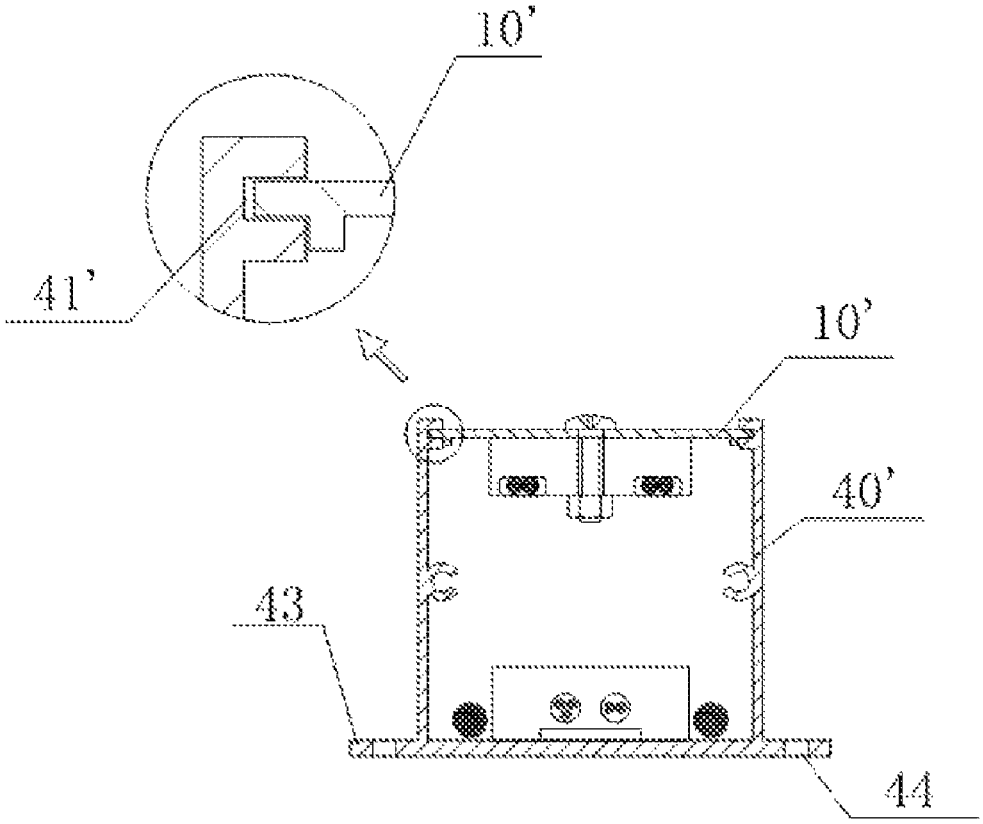
FIG. 3*b* is a cross-sectional view of a LED side marker lamp in FIG. 3*a;*
Figure 3C:
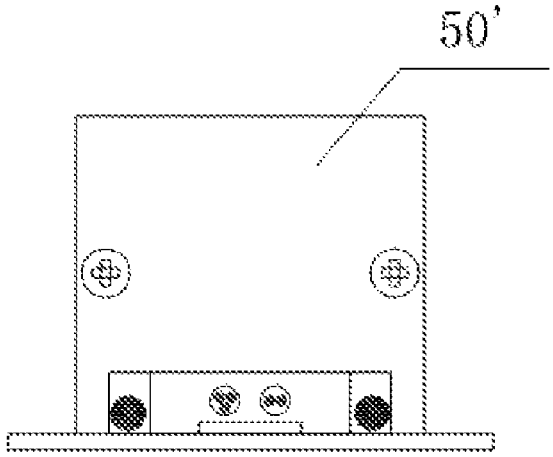
FIG. 3*c* is a schematic structure view of an end cover of a second embodiment of the present invention.

As shown in FIGS. 3*a*-3*c*, structure of the LED side marker lamp of a second embodiment of the invention is almost the same as that of a first embodiment, except that a receiving edge 43 is extended from the bottom of a bottom slot 40' shown in FIG. 2*a*, and a receiving hole 44 operating to receive the LED side marker lamp is disposed thereon. Further, a buckling slot 41' is disposed at the opening at the top of the bottom slot 40', and is fit with the punching panel 10', and the punching panel 10' is clearance-fit in the buckling slot 41'. In details, a diameter of the opening at the top of the bottom slot 40' is the same as that of the punching panel 10', namely, a distance between both sides of the bottom slot 41' is the same as a width of the punching panel 10'. Therefore, the punching panel 10' is not interference-fit with the bottom slot 40', but is placed in the slot 41' of the bottom slot 40' before the end cover 50' is installed. The punching panel 10' is clearance-fit with the bottom slot 40'.

Figure 4A:
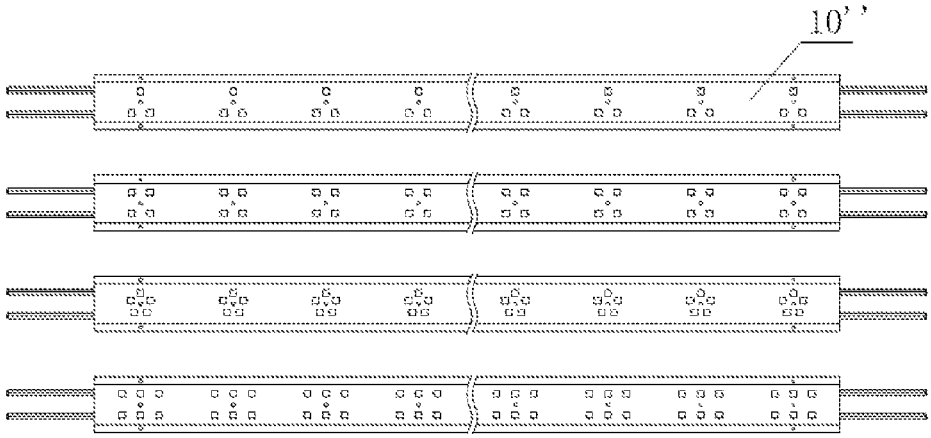
FIG. 4*a* is a front view of a LED side marker lamp of a third embodiment of the present invention.
Figure 4B:
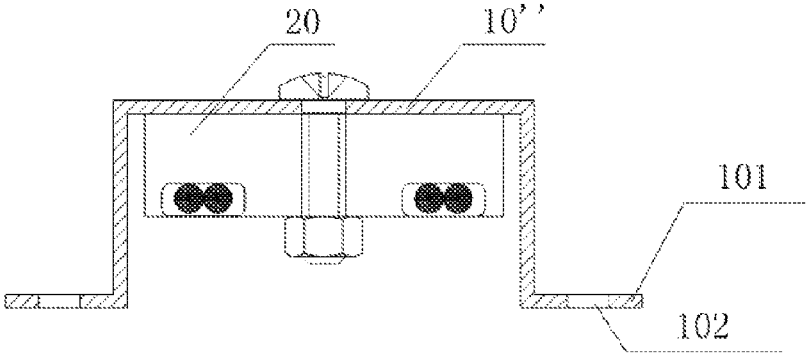
FIG. 4*b* is a cross-sectional structure view of the LED side marker lamp according to FIG. 4*a*.

As shown in FIGS. 4*a* and 4*b*, structure of the LED side marker lamp of a third embodiment of the invention is almost the same as that described of the first embodiment, except that the punching panel 10" shown in FIG. 4*a* is groove-shaped and bends outward to form a receiving edge 101, and a receiving hole 102 operating to receive the LED side marker lamp is disposed on the receiving edge 101. An installation process of the LED side marker lamp is as follows: the waterproof light source module 20 is fixed at the bottom of the punching panel 10" via a screw and a nut, the power bus passes through the bottom of the punching panel 10"; and finally the LED side marker lamp is fixed on the decorated building via the installation hole 102. Compared with the above-mentioned structure, the LED of this structure is simple in structure and convenient for installation because the punching panel 10" is used as the shell of the LED side marker lamp directly, and the bottom slot and end cover are omitted.

Figure 5A:
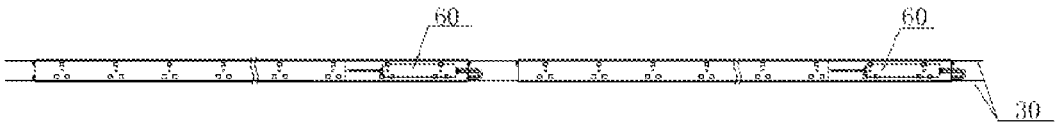
FIGS. 5*a* and 5*b* illustrate installation of a water-proof power supply of the invention.
Figure 5B:
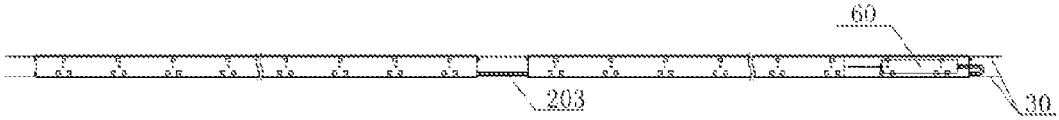

As shown in FIGS. 5*a* and 5*b*, the LED side marker further comprises multiple water-proof power supplies 60 fixed on the punching panel or in the bottom slot. The water-proof power supplies are built-in and the number of water-proof power supplies is the same as that of the LED side marker lamps (as shown in FIG. 5*a*). Alternatively, the number of the water-proof power supplies is one and the water-proof power supply is shared by multiple interconnected LED side marker lamps (as shown in FIG. 5*b*). When multiple LED side marker lamps are used, multiple power lines 203 other than the power bus 30 are required for connecting the LED side marker lamps.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

What is claimed is:

1. A light emitting diode (LED) side marker lamp, comprising:

a punching panel with a coating;

a water-proof light source module; and a through hole; and a bottom slot operating to support said punching panel, wherein said water-proof light source module is disposed below said punching panel; and said through hole is disposed on said punching panel and operates to allow light to be emitted from said water-proof light source module; and wherein a second opening is disposed at the top of said bottom slot;

a buckling slot is disposed at said second opening;

a protruding portion bending inwards is disposed at the edge of said punching panel and fit with said buckling slot; and said punching panel is interference-fit in said buckling slot.

2. A light emitting diode (LED) side marker lamp, comprising:

a punching panel with a coating;

a water-proof light source module;

a through hole; and a bottom slot operating to support said punching panel, wherein said water-proof light source module is disposed below said punching panel; and said through hole is disposed on said punching panel and operates to allow light to be emitted from said water-proof light source module; and wherein a second opening is disposed at the top of said bottom slot;

a buckling slot is disposed at said second opening and fit with said punching panel; and said punching panel is clearance-fit in said buckling slot.

3. The LED side marker lamp of claim 2, further comprising a pair of first openings being disposed on both ends of said bottom slot, and an end cover being disposed at each first opening.

4. The LED side marker lamp of claim 2, wherein said punching panel is groove-shaped, and an edge thereof bends outward whereby forming a receiving edge.

5. The LED side marker lamp of claim 2, wherein said water-proof light source module comprises a plurality of light source units;

each light source unit comprises a groove-shaped shell, a PCB board, at least one LED lamp, and a water-proof insulation layer;

said PCB board is disposed in said groove-shaped shell;

said LED lamp is disposed on said PCB board; and said water-proof insulation layer operates to cover said PCB board and part of said LED lamp.

6. The LED side marker lamp of claim 5, wherein said groove-shaped shell is made of metal or plastics.

7. The LED side marker lamp of claim 5, wherein said LED lamp is one of a red-light LED lamp, a green-light LED lamp, a blue-light LED lamp, or a combination thereof.

8. The LED side marker lamp of claim 5, wherein said light source unit further comprises a communication electronic component operating to control on or off of said LED lamp.

9. The LED side marker lamp of claim 8, further comprising a communication line operating to connect said water-proof light source module to an external control unit.

10. The LED side marker lamp of claim 8, further comprising a built-in control unit connected to said communication electronic component of said water-proof light source module and operating to turn on said light source unit one by one.

11. The LED side marker lamp of claim 2, further comprising at least one water-proof power supply disposed on said punching panel or in said bottom slot.

12. A lamp system, comprising:

at least two light emitting diode (LED) side marker lamps, each LED side marker lamp comprising:

a punching panel with a coating;

a water-proof light source module;

a through hole; and a bottom slot operating to support said punching panel, wherein said water-proof light source module is disposed below said punching panel; and said through hole is disposed on said punching panel and operates to allow light to be emitted from said water-proof light source module; and wherein a second opening is disposed at the top of said bottom slot;

a buckling slot is disposed at said second opening and fit with said punching panel; and said punching panel is clearance-fit in said buckling slot.

13. The lamp system of claim 12, further comprising a power bus operating to connect adjacent LED side marker lamp or an external power supply.

14. The lamp system of claim 13, wherein said LED side marker lamps are connected to each other via power lines.

15. The lamp system of claim 12, further comprising at least one water-proof power supplies disposed on said punching panel or in a bottom slot operating to support said punching panel.

16. The lamp system of claim 15, wherein the number of said water-proof power supplies is the same as that of said LED side marker lamps.

17. The lamp system of claim 15, wherein the number of said water-proof power supplies is one, and said LED side marker lamps connected to each other share the same water-proof power supply.

* * * * *